US008149201B2

(12) United States Patent
Chao et al.

(10) Patent No.: US 8,149,201 B2
(45) Date of Patent: Apr. 3, 2012

(54) LIQUID CRYSTAL DISPLAY (LCD) DRIVING APPARATUS AND METHOD

(75) Inventors: Yue-Li Chao, Taipei County (TW); Pin-Hung Chou, Taipei (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 450 days.

(21) Appl. No.: 12/542,660

(22) Filed: Aug. 17, 2009

(65) Prior Publication Data

US 2010/0309192 A1 Dec. 9, 2010

(30) Foreign Application Priority Data

Jun. 5, 2009 (TW) ..... 98118799 A

(51) Int. Cl.
*G09G 3/36* (2006.01)

(52) U.S. Cl. ..... 345/89; 345/87; 345/214; 345/690

(58) Field of Classification Search ..... 345/87–100, 345/204–215, 690
See application file for complete search history.

(56) References Cited

U.S. PATENT DOCUMENTS

2010/0090938 A1* 4/2010 Kamada et al. ..... 345/92
2010/0103206 A1* 4/2010 Kamada et al. ..... 345/690

FOREIGN PATENT DOCUMENTS

TW 200745938 12/2007

* cited by examiner

*Primary Examiner* — Vijay Shankar
(74) *Attorney, Agent, or Firm* — Jianq Chyun IP Office

(57) ABSTRACT

An LCD driving apparatus and an LCD driving method are provided in the application. The LCD driving apparatus includes a difference value circuit which determines whether to enable an overdriving circuit and a memory controller according to a gray level variation between two adjacent frames. When the gray level variation between two adjacent frames is less than a predetermined threshold, the overdriving circuit and the memory controller are disabled so as to reduce power consumption.

8 Claims, 3 Drawing Sheets

LIQUID CRYSTAL DISPLAY (LCD) DRIVING APPARATUS AND METHOD

CROSS-REFERENCE TO RELATED APPLICATION

This application claims the priority benefit of Taiwan application serial no. 98118799, filed on Jun. 5, 2009. The entirety of the above-mentioned patent application is hereby incorporated by reference herein and made a part of specification.

BACKGROUND OF THE INVENTION

1. Field of Invention

The present invention relates to a liquid crystal display (LCD) driving apparatus and method. More particularly, the present invention relates to an LCD driving apparatus and method that reduces power consumption.

2. Description of Related Art

Liquid crystal displays (LCDs) have broad applications. With the development of related LCD driving technologies, the LCDs have advantages of lower power consumption, thin thickness and light-weight. LCDs are frequently used in electronic devices such as televisions, laptop computers, and computer monitors. With advantages such as small volumes, low power consumption, and no radiation, thin film transistor liquid crystal display (TFT-LCD) have already become one of the most popular products in the display market.

However, in order to improve the response time of an LCD, an LCD driving apparatus frequently uses an overdriving circuit to speed up the state transition of the liquid crystal. Please refer to FIG. 1, which shows an LCD driving circuit of the related art. The LCD driving circuit includes a memory 110, a memory controller 120, and an overdriving circuit 130. The memory controller 120 stores the data of a previous frame into the memory 110. Then, the overdriving circuit 130 reads the data of the previous frame from the memory 110, compares the data of the previous frame with the data of a current frame, and accordingly outputs overdriving frame data. The overdriving circuit 130 speeds up the pixel response time through adjusting the driving signal according to the variations of the frames. This related art keeps on storing each frame into the memory 110 and reading each previous frame out from the memory 110. However, if the gray levels of the frames do not change, the continual and unconditional storing and reading will waste power and do not good to the frame displaying quality.

SUMMARY OF THE INVENTION

Accordingly, the present invention is directed to provide an LCD driving apparatus and an LCD driving method. The LCD driving apparatus and the LCD driving method selectively enable an overdriving circuit and a memory controller according to the extent of the gray level variation of the frames. When the gray level variation of the frames is relatively small, the overdriving circuit and the memory controller are disabled to reduce power consumption.

The present invention provides an LCD driving method adapted to an LCD driving apparatus. The LCD driving apparatus includes a memory, a memory controller, and an overdriving circuit. The driving method includes the following steps. First, partition each of a plurality of frames into a plurality of pixel blocks. Then, receive first frame data and second frame data in turn. Next, obtain a plurality of first gray level differences corresponding to the first frame data and a plurality of second gray level differences corresponding to the second frame data according to the pixel gray level values corresponding to each of the pixel blocks. Finally, compare the first gray level differences with the second gray level differences to determine whether to enable the memory controller and the overdriving circuit.

According to an embodiment of the present invention, the pixel blocks are M×N matrix blocks, where M and N are positive integers. The gray level differences are calculated according to equation:

$$SOD(R, C) = \sum_{m=R}^{R+Q-1} \sum_{n=C}^{C+Y-1} |P(m, n) - P(m, n-1)|,$$

where SOD(R, C) represents the gray level differences, (R, C) represents the upper-left pixel coordinates of the pixel blocks, (m, n) represents the pixel coordinates, P(m, n) represents the pixel gray level values of the frame data, Q represents the pixel number corresponding to the height of each of the pixel blocks, Y represents the pixel number corresponding to the width of each of the pixel blocks, P(m, 0)=0 when n=1, and R, C, m, Q and Y are positive integers.

According to an embodiment of the present invention, the step of comparing the first gray level differences with the second gray level differences includes the following substeps. First, compare the first gray level differences with the second gray level differences of corresponding pixel blocks, and determines an effective difference according to whether each of the differences between the first gray level differences and the second gray level differences is larger than a first threshold. Second, enable the memory controller and the overdriving circuit when the effective difference is larger than a second threshold, and disable the memory controller and the overdriving circuit when the effective difference is smaller than the second threshold.

From another perspective, the present invention provides an LCD driving apparatus for driving an LCD. The LCD driving apparatus includes a memory, a memory controller coupled to the memory, an overdriving circuit coupled to the memory controller, and a difference value circuit. The overdriving circuit generates overdriving frame data. The difference value circuit is coupled to the memory controller and the overdriving circuit. The difference value circuit partitions a plurality of frames into a plurality of pixel blocks, receives first frame data and second frame data, obtains a plurality of first gray level differences corresponding to the first frame data and a plurality of second gray level differences corresponding to the second frame data according to a plurality of pixel gray level values corresponding to each of the pixel blocks, compares the first gray level differences with the second gray level differences to determine whether to enable the memory controller and the overdriving circuit. The LCD driving apparatus can perform the aforementioned LCD driving method, the details of which will not be repeated here.

The present invention gauges the extent of frame gray level variation to determine whether to disable the overdriving circuit and the memory controller. Without sacrificing the frame displaying quality, the present invention reduces power consumption through disabling the overdriving circuit and the memory controller.

In order to the make the aforementioned and other objects, features and advantages of the present invention comprehensible, embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
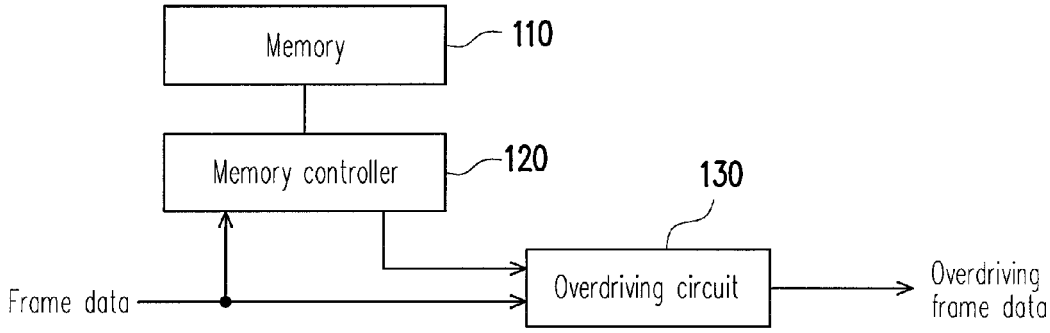
FIG. 1 (RELATED ART)
FIG. 1 shows an LCD driving circuit of the related art.
Figure 2:
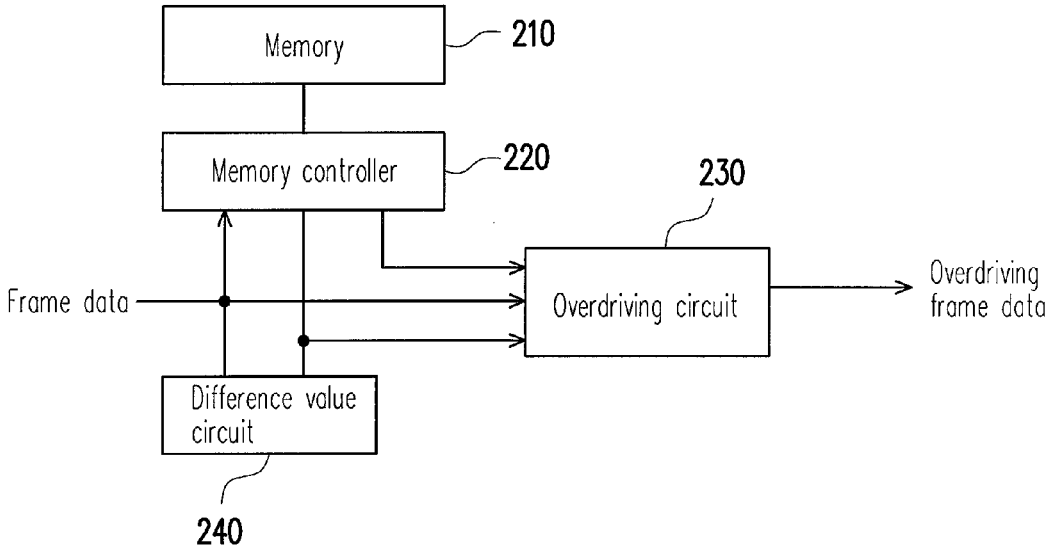
FIG. 2 shows an LCD driving apparatus according to an embodiment of the present invention.

Please refer to FIG. 2, which shows an LCD driving apparatus according to an embodiment of the present invention. The LCD driving apparatus includes a memory 210, a memory controller 220, an overdriving circuit 230, and a difference value circuit 240. The overdriving circuit 230 and the difference value circuit 240 are coupled to the memory controller 220. The memory controller 220 controls the read/write operations on the memory 210. The overdriving circuit 230 performs overdriving calculations to generate overdriving frame data.

The difference value circuit 240 performs calculations on received frame data to obtain corresponding gray level differences, compares the gray level differences of two adjacent frames to determine whether to enable the overdriving circuit 230 and the memory controller 220. If the two adjacent frames have a relatively great gray level variation, the difference value circuit 240 will enable the overdriving circuit 230 and the memory controller 220. The enabled memory controller 220 will store the received frame data, and the enabled overdriving circuit 230 will perform the overdriving calculations. If the two adjacent frames have a relatively trivial gray level variation, the difference value circuit 240 will disable the overdriving circuit 230 and the memory controller 220. The disabled memory controller 220 will not store the received frame data, and the disabled overdriving circuit 230 will not perform the overdriving calculations. Power consumption is therefore reduced.

Figure 3:
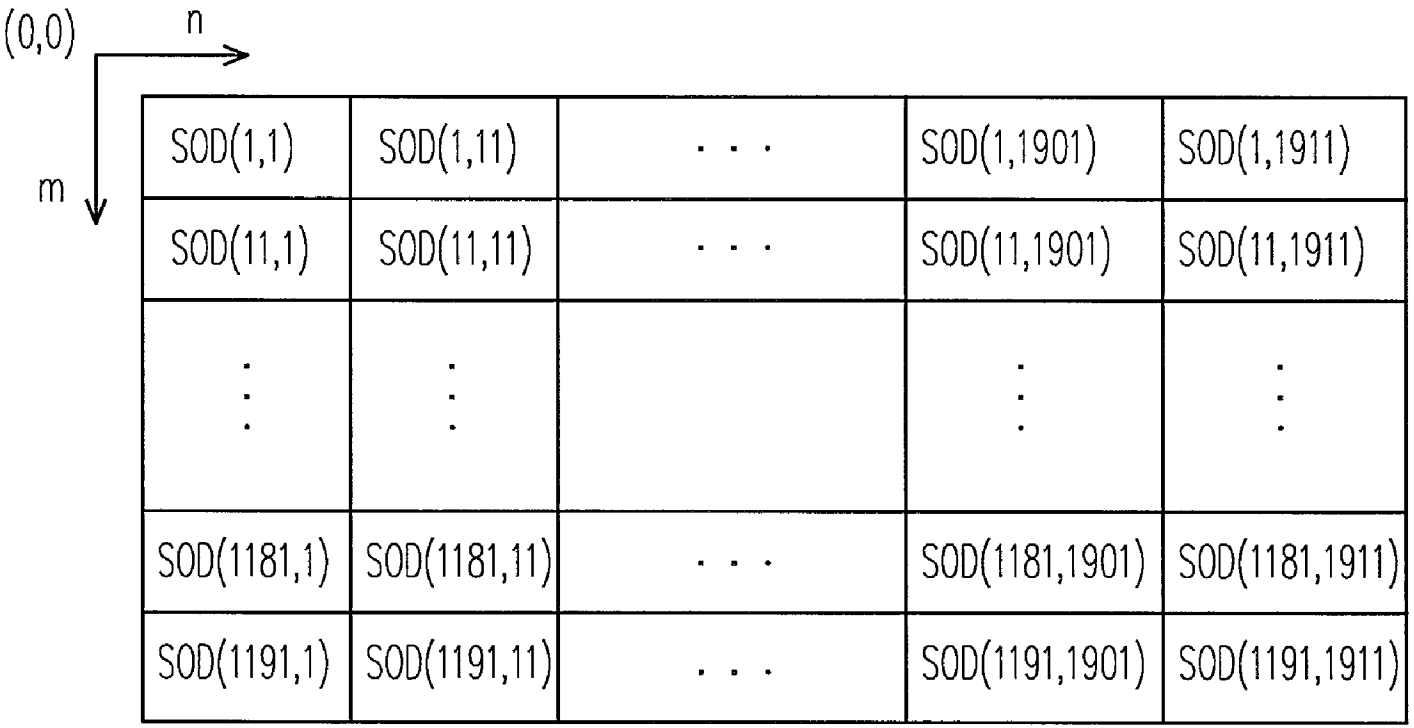
FIG. 3 shows a diagram illustrating the pixel blocks of the embodiment.

The difference value circuit 240 calculates the gray level differences as follows. First, each of the frames is partitioned into a plurality of pixel blocks, as shown in FIG. 3. FIG. 3 uses a display panel having a 1920×1200 resolution as an example. The size of each of the pixel blocks is 10×10. SOD(R, C) represents the gray level difference of the pixel block having an upper-left corner coordinate (R, C). SOD(R, C) is determined according to the following equation.

$$SOD(R, C) = \sum_{m=R}^{R+Q-1} \sum_{n=C}^{C+Y-1} |P(m, n) - P(m, n-1)|,$$

where (m, n) represents the pixel coordinates, P(m, n) represents the pixel gray-level values of the frame data, Q represents the pixel number corresponding to the height of each of the pixel blocks, and Y represents the pixel number corresponding to the width of each of the pixel blocks. When n=1, P(m, 0)=0. According to the equation, the gray level difference is the summation of the absolute difference between each given pixel and the pixel to the left of the given pixel. As to the pixels on the left edge of the pixel block, such as P(1, 1)~P(10, 1), because there is no pixel to their left, the pixels simply retain their gray level values. Please note that the above equation is not the only means for marking the pixel blocks. Therefore, the equation is not a necessary limitation of the embodiment. In addition, the pixel blocks can have a size other than 10×10. Therefore, the 10×10 size is not a necessary limitation of the embodiment.

While receiving the data of successive frames, the difference value circuit 240 in turn calculates the gray level differences corresponding to the frames. The difference value circuit 240 then compares the gray level differences of two adjacent frames according to the locations of the pixel blocks. If the difference of two gray level differences corresponding to a same pixel block is larger than a first predetermined threshold, the corresponding pixel block is marked as an effective difference block. The mark indicates that the pixel block has a relatively larger gray level variation. An effective difference can be determined through performing a statistics calculation on the effective difference blocks. For example, the effective difference of a frame equals to the number of effective difference blocks in the frame. Therefore, the effective difference indicates the extent of gray level variation of the frame. If the effective difference is larger than a predetermined second threshold, the memory controller 220 and overdriving circuit 230 are enabled to facilitate the frame overdriving operation. If the effective difference is smaller than the predetermined second threshold, the memory controller 220 and overdriving circuit 230 are disabled to reduce power consumption.

When the effective difference is smaller than the predetermined second threshold, the whole frame has a relatively smaller gray level variation. Under the circumstances, disabling the memory controller 220 and the overdriving circuit 230 will not affect the quality of the frame, but will reduce the power consumption of the memory controller 220 and the memory 210. In other words, the embodiment determines whether to enable the overdriving circuit 230 to facilitate the overdriving operation. In addition, the embodiment also provides a method for gauging the extent of the gray level variations of the frames. Specifically, in the embodiment, the frames are partitioned into a plurality of pixel blocks, the gray level difference of each of the pixel blocks is calculated, the extent of the gray level variations is determined through comparing the gray level differences of two adjacent frames. Please note that the difference value circuit 240 needs only the gray level differences of each of the frames for comparison. The comparison of gray level differences does not necessitate the storage of the whole frame. Only when the overdriving circuit 230 is enabled will the whole frame be stored.

Figure 4:
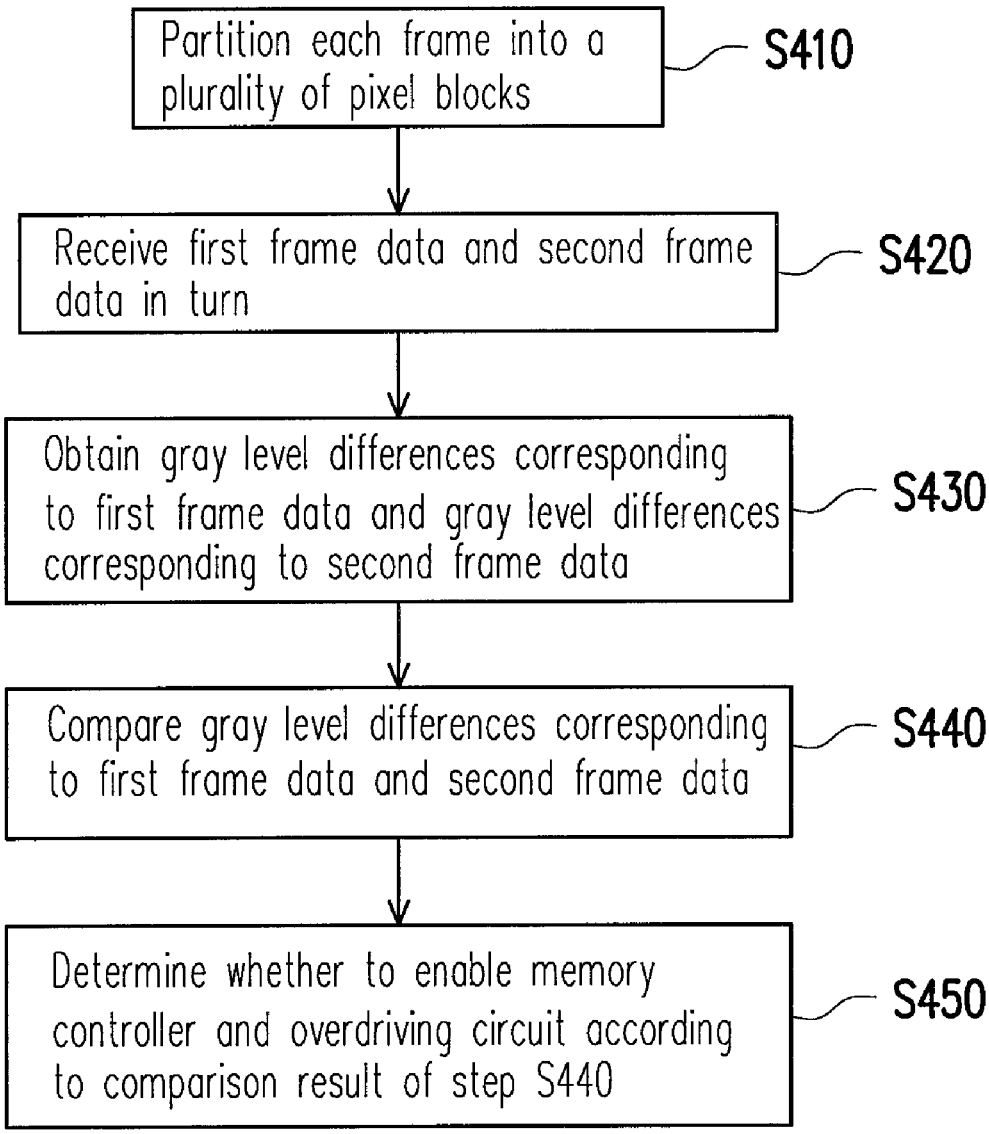
FIG. 4 shows an LCD driving method according to an embodiment of the present invention.

From another perspective, the present invention provides an LCD driving method. FIG. 4 shows an LDC driving method according to an embodiment of the present invention. The LCD driving method can be used by an LCD driving apparatus. The LCD driving apparatus includes, a memory, a memory controller, and an overdriving circuit. The LCD driving method includes the following steps. Step S410: partition a plurality of frames into a plurality of pixel blocks. Step S420: receive first frame data and second frame data in turn. Step S430: obtain the gray level differences corresponding to the first frame data and the gray level differences corresponding to the second frame data. Step S440: compare the gray level differences corresponding to the first; frame data with the gray level differences corresponding to the second frame data. Step S450: determine whether to enable the memory controller and the overdriving circuit according to a comparison result of step S440. In step S450, if the differences between the gray level differences of the two adjacent frames are relatively large, the memory controller and the overdriving circuit will be enabled. On the contrary, if the differences between the gray level differences of the two adjacent frames are relatively small, the memory controller and the overdriving circuit will be disabled to reduce power consumption.

As mentioned, the present invention provides a method that gauges the extent of the gray level variation between two adjacent frames according to the gray level differences of the two frames. Then, the memory controller and the overdriving circuit are selectively disabled according to the extent of the gray level variation. Therefore, the method reduces the power consumption of the memory controller and the overdriving circuit. Those LCDs that adopt the method of the present invention can save power when the frames are not varying or have a smaller variation, and at the same time maintain the display quality.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. An liquid crystal display (LCD) driving apparatus, comprising: a memory; a memory controller, coupled to the memory; an overdriving circuit, coupled to the memory controller, for generating overdriving frame data; and a difference value circuit, coupled to the memory controller and the overdriving circuit, the difference value circuit partitioning each of a plurality of frames into a plurality of pixel blocks, receiving first frame data and second frame data, obtaining a plurality of first gray level differences corresponding to the first frame data and a plurality of second gray level differences corresponding to the second frame data according to a plurality of pixel gray level values corresponding to each of the pixel blocks, and comparing the first gray level differences with the second gray level differences to determine whether to enable the memory controller and the overdriving circuit; wherein the first gray level differences correspond to the pixel blocks, the first gray level differences are calculated according to equation:

SOD(R, C)=m=RR+Q−1n=CC+Y−1P(m, n)−P(m, n−1), ##EQU00005## where SOD(R, C) represents the first gray level differences, (R, C) represents the upper-left pixel coordinates of the pixel blocks, (m, n) represents the pixel coordinates, P(m, n) represents the pixel gray level values of the first frame data, Q represents the pixel number corresponding to the height of each of the pixel blocks, Y represents the pixel number corresponding to the width of each of the pixel blocks, P(m, 0)=0 when n=1, and R, C, m, Q, and Y are positive integers.

2. The LCD driving apparatus of claim 1, wherein the pixel blocks are M×N matrix blocks, where M and N are positive integers.

3. The LCD driving apparatus of claim 1, wherein the second gray level differences correspond to the pixel blocks, the second gray level differences are calculated according to equation:

$$SOD(R, C) = \sum_{m=R}^{R+Q-1} \sum_{n=C}^{C+Y-1} |P(m, n) - P(m, n-1)|,$$

where SOD(R, C) represents the second gray level differences, (R, C) represents the upper-left pixel coordinates of the pixel blocks, (m, n) represents the pixel coordinates, P(m, n) represents the pixel gray level values of the second frame data, Q represents pixel number corresponding to the height of each of the pixel blocks, Y represents the pixel number corresponding to the width of each of the pixel blocks, P(m, 0)=0 when n=1, and R, C, m, Q, and Y are positive integers.

4. The LCD driving apparatus of claim 1, wherein the difference value circuit compares the first gray level differences with the second gray level differences of corresponding pixel blocks, determines an effective difference according to whether each of the differences between the first gray level differences and the second gray level differences is larger than a first threshold, enables the memory controller and the overdriving circuit when the effective difference is larger than a second threshold, and disables the memory controller and the overdriving circuit when the effective difference is smaller than the second threshold.

5. An liquid crystal display (LCD) driving method adapted to an LCD driving apparatus, the driving apparatus comprising a memory, a memory controller, and an overdriving circuit, the driving method comprising: partitioning each of a plurality of frames into a plurality of pixel blocks; receiving first frame data and second frame data; obtaining a plurality of first gray level differences corresponding to the first frame data and a plurality of second gray level differences corresponding to the second frame data according to a plurality of pixel gray level values corresponding to each of the pixel blocks; and comparing the first gray level differences with the second gray level differences to determine whether to enable the memory controller and the overdriving circuit; wherein the first gray level differences correspond to the pixel blocks of the first frame data, the first gray level differences are calculated according to equation:

SOD (R, C)=m=RR+Q−1n=CC+Y−1P(m, n)−P(m, n−1), ##EQU00003## where SOD(R, C) represents the first gray level differences, (R, C) represents the upper-left pixel coordinates of the pixel blocks, (m, n) represents the pixel coordinates, P(m, n) represents the pixel gray level values of the first frame data, Q represents the pixel number corresponding to the height of each of the pixel blocks, Y represents the pixels number corresponding to the width of each of the pixel blocks, P(m, 0)=0 when n=1, and R, C, m, Q, and Y are positive integers.

6. The LCD driving method of claim 5, wherein the pixel blocks are M×N matrix blocks, where M and N are positive integers.

7. The LCD driving method of claim 5, wherein the second gray level differences correspond to the pixel blocks of the second frame data, the second gray level differences are calculated according to equation:

$$SOD(R, C) = \sum_{m=R}^{R+Q-1} \sum_{n=C}^{C+Y-1} |P(m, n) - P(m, n-1)|,$$

where SOD(R, C) represents the second gray level differences, (R, C) represents the upper-left pixel coordinates of the pixel blocks, (m, n) represents the pixel coordinates, P(m, n) represents the pixel gray level values of the second frame data, Q represents the pixel number corresponding to the height of each of the pixel blocks, Y represents the pixel number corresponding to the width of each of the pixel blocks, P(m, 0)=0 when n=1, and R, C, m, Q, and Y are positive integers.

8. The LCD driving method of claim 5, wherein the step of comparing the first gray level differences with the second gray level differences comprises:

comparing the first gray level differences with the second gray level differences of corresponding pixel blocks, and determining an effective difference for each of the pixel blocks according to whether each of the differences between the first gray level differences and the second gray level differences is larger than a first threshold; and enabling the memory controller and the overdriving circuit when the effective difference is larger than a second threshold, and disabling the memory controller and the overdriving circuit when the effective difference is smaller than the second threshold.

* * * * *